United States Patent [19]

Ludwig et al.

[11] Patent Number: 4,713,498

[45] Date of Patent: Dec. 15, 1987

[54] SWITCH GEAR

[75] Inventors: Bernd Ludwig, Marienheide; Dirk Stiehl, Gummersbach, both of Fed. Rep. of Germany

[73] Assignee: Square D Starkstrom GmbH, Fed. Rep. of Germany

[21] Appl. No.: 918,906

[22] Filed: Oct. 15, 1986

[30] Foreign Application Priority Data

Oct. 24, 1985 [EP] European Pat. Off. ..... 85113511.1

[51] Int. Cl.[4] ..... H01H 9/00; H01H 15/00

[52] U.S. Cl. ..... 200/5 R; 200/16 A; 200/18; 200/153 L; 200/243; 200/307

[58] Field of Search ..... 200/5 R, 16 A, 17 R, 200/18, 153 L, 158, 243, 307, 153 LA, 153 LB

[56] References Cited

U.S. PATENT DOCUMENTS

| | | | |
|---|---|---|---|
| 2,422,097 | 6/1947 | Hansen | 200/16 A X |
| 2,761,041 | 8/1956 | Yarrick | 200/16 A X |
| 2,918,554 | 12/1959 | Brauheck | 200/307 X |
| 2,947,827 | 8/1960 | Bundy | 200/16 A |
| 3,201,533 | 8/1965 | Fredrickson | 200/16 A |
| 4,335,288 | 6/1982 | Ludwig et al. | 200/307 |
| 4,401,863 | 8/1983 | Lemmer et al. | 200/243 X |

*Primary Examiner*—J. R. Scott

*Attorney, Agent, or Firm*—Diller, Ramik & Wight

[57] ABSTRACT

A switch gear which includes a housing have first and second sides and a third side therebetween, at least one main contact bridge in the housing displaceable between two ON-OFF switch position, a spindle rotatable by a handle and carrying a body having a cam slot receiving a cam follower of a contact bridge holder, the contact bridge holder carrying contacts for effecting the two switch positions with associated pairs of fixed contact rails carried by the housing, the fixed contact rails being connectable by connector screws to electrical hook-up leads at the respective first and second housing sides, first and second separate housing compartments adjacent the first and second housing sides and carried associated ones of the connector screws, the first and second contact rails being connected through the respective first and second separate housing compartments for connection to the electrical hook-up leads by the connector screws, and the first and second separate housing compartments being selectively mounted to the respective first and second housing sides at two positions mutually positioned by 180° whereby the connector screws can be accessed from two opposing/opposite directions.

24 Claims, 19 Drawing Figures

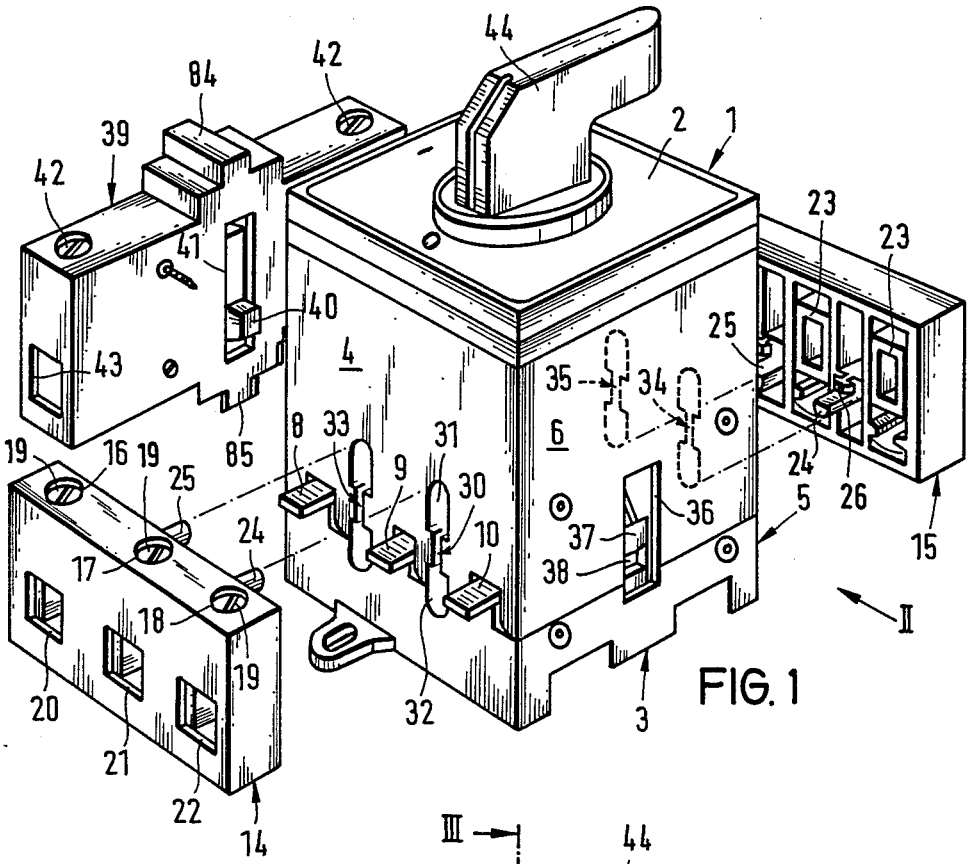
FIG. 1
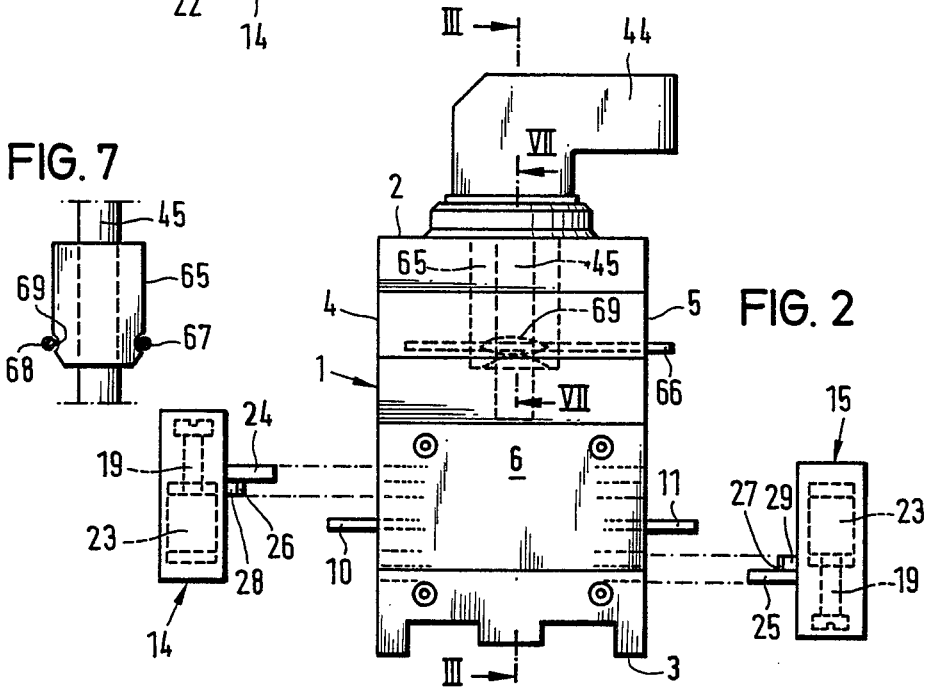
FIG. 2
FIG. 7

SWITCH GEAR

BACKGROUND OF THE INVENTION

This invention relates to novel switch gear which includes a housing of a generally rectangular cross-sectional configuration defined by four side walls, a top wall and a rear wall. An actuation device is carried by the top wall for operating at least one main contact bridge displaceable generally normally toward and away from the top and bottom walls to effect "ON" and "OFF" switch positions with at least two fixed associated contact rails. The fixed contact rails have ends projecting through opposite side walls of the housing for electrical connection to electrical leads by associated connector screws.

A switch gear of the type just described in normally mounted in practice under very diverse operational conditions. However, two basic types of mounting can be distinguished. In one type of mounting the actual switch gear is fastened behind an assembly plate and the actuation means is located on a side opposite thereto, namely, on the operating side of the assembly plate through an associated bore hole or other aperture in the assembly plate through suitable connecting elements. This type of switch gear mounting is employed frequently in switching desks or control panels where it is desired to have quick access to the switch gear.

Another and basically different type of mounting of the switch gear involves a separate switch gear mounted serially next to and one above the other within a switching desk. In this case, standard support rails are often used to serially fix the switch gears in place and the support rails are in turn generally electrically connected to the inside of a switching cabinet. Often the switch gear can be mounted directly onto a support plate whereby the back of a particular switch gear rests against that particular support plate.

Most conventional switch gear is equipped with a number of connector screws for connecting electrical leads thereto. There may be six connector screws for each switch gear but more often than not, there is substantially more. Obviously, a problem arises because the switch gear must be first fixed in place before the electrical hook-up leads can be assembled, tightened and clamped by the connector screws. When mounting switch gear of the type first mentioned herein, namely on the back side of an assembly plate, access to the connector screws can be achieved in practice only from the back of the switch gear, which at times is at a minimum inconvenient and at times more often than not virtually impossible due to lack of accessibility.

As to the second-mentioned mounting type, access and actuation of the connector screws by a screwdriver can only take place from the front side of the switch gear. Hence, conventional switch gear of both types just described suffer from the serious drawback of the difficulty of mounting and/or assembling thereto appropriate electrical hook-up leads. This has been overcome by innumerable variations in styles, shapes and designs of switch gear, but the difficulty here is that a substantial stockpile of such different types of switch gear is the only certain approach to solving in particular mounting problem, but such stockpiles represent undesired capital asset expenditures.

SUMMARY OF THE INVENTION

In keeping with the foregoing, a primary object of the present invention is to provide a novel switch gear which allows a simple and convenient change-over or manipulation to effect diverse mounting in a very simple manner with most any type of conventional electrical hook-up systems.

In keeping with the foregoing, the novel switch gear of this invention includes separate housing compartments housing the connector screws for the electrical hook-up leads, and these separate housing compartments can be selectively secured to the main switch gear housing in either of two positions mutually offset 180° from each other. Due to the latter, the connector screws of the separate housing compartments can be accessed from either the top or bottom (or from the front or rear) depending upon the particular relationship of the switch gear to its associated electrical mounting. Preferably the main housing of the switch gear has a plurality of pairs of fixed contact rails with project outwardly from the main switch gear housing and enter the separate housing compartments through associated openings.

In further accordance with this invention auxiliary contact compartments are provided with a slot through which projects a projection or movable contacts, and the latter projection in turn projects through slots in the main switch gear housing or cooperation with the movable bridge contacts. In this fashion two separate housing compartments can be mounted on opposite sides of the main switch gear housing and two other auxiliary contact compartments could be mounted on the remaining opposite sides of the main switch gear housing. In this fashion the overall switch gear occupies a minimum of space and yes is readily adapted for most any type of mounting and any type of switching/hook-up conditions.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is an exploded perspective view of the novel switch gear of this invention, and illustrates a main switch gear housing, its associated walls, three pairs of fixed contact rails projecting therefrom, and associated separate housing compartments and auxiliary contact compartments.

FIG. 2 is a side elevational view looking along the arrow II of FIG. 1, and illustrates the manner in which the separate housing compartments are connected to the main housing of the switch gear.

FIG. 7, which appears on the sheet containing FIGS. 1 and 2, is a partial sectional view taken along the line VII—VII of FIG. 2, and illustrates the manner in which a sleeve is grooved to receive legs of a U-shaped clip for assembly to the main switch gear housing.

DESCRIPTION OF THE PREFERRED EMBODIMENTS

Figure 3:
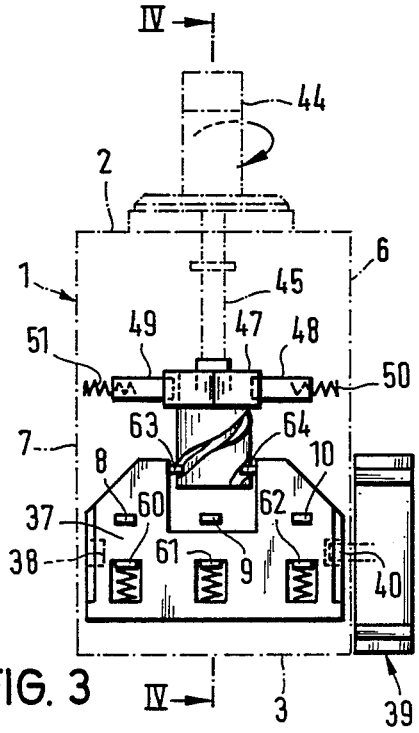
FIG. 3 is a fragmentary view of the switch gear taken along the line III—III of FIG. 2 with its housing removed, and illustrates an actuator mechanism for reciprocating a contact bridge holder.

The novel switch gear of this invention is fully illustrated in FIG. 1. and includes a generally cube-like housing 1 which is essentially rectangular in cross-sectional configuration throughout. The housing 1 of the switch gear includes a front or top wall or side 2 and a lower, bottom or rear side or wall 3. The housing 1 also includes four side walls 4, 5, 6 and 7 of which the walls 4, 5 and 6, 7 are in generally spaced parallel relationship to each other, as are, of course, the walls or sides 2, 3. Six fixed contact rails 8, 9, 10 (FIGS. 1, 3 and 5), 11 (FIG. 2), 12 and 13 (FIGS. 4 and 6) are carried by the housing 1 partially therewithin and partially projecting therefrom, as is most evident in FIGS. 1, 2, 4 and 6 of the drawings. The fixed contact rails 8 through 13 project from opposite directions through the side walls 4, 5 (See FIGS. 4 and 6) for electrical connection to associated electrical hook-up leads (not shown) through separate housing compartments 14, 15. The housing compartments 14, 15 carry connector screws 19 for connecting the electrical hook-up leads (not shown) to the fixed contact rails 8 through 13 when the housing compartments 14, 15 are moved from the disassembled position (FIG. 2) to the assembled position against the walls 4, 5, as is apparent in FIG. 8. The number of connector screws 19 correspond to the number of fixed contact rails 8 through 13 and, obviously, in this case there are six connector screws 19 with three connector screws 19 being housed within the housing compartment 14 and three connector screws 19 being housed in the housing compartment 15. Heads (unnumbered) of the connector screws 19 are visible through bore holes 16, 17 and 18 of the housing compartments 14, 15. The bore holes 16, 17 and 18 are of a diameter less than the diameter of the heads (unnumbered) of the connector screws 19 and, thus, the connector screws 19 can not inadvertently or accidentally dislodge from the housing compartments 14, 15 through the bore holes 16, 17 and 18. The connector screws 19 are threaded into generally rectangular metal cages 23, and the metal cages 23 can be displaced up and down within the associated housing compartments 14, 15 by the associated screws 19. Each housing compartment 14, 15 also includes three apertures 20, 21 and 22 through which the electrical hook-up leads can be inserted into the housing compartments 14, 15 for connection thereof to the cages 23 by the screws 19 which, of course, also connect the cages 23 to the exposed ends (unnumbered) of the fixed contact rails 8 through 13 when the housing compartments 14 and/or 15 are assembled tight against the walls 4, 5.

Figure 9:
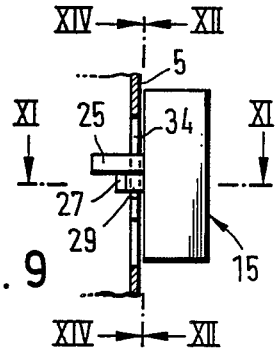
FIG. 9 is a partial cross-sectional view of one of the housing side walls, and illustrates one of the separate housing compartments loosely assembled thereto.
Figure 10:
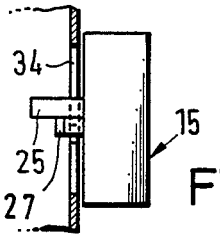
FIG. 10 is a similar partial cross-sectional view to that shown in FIG. 9, but illustrates the tightly clamped/-secured position of the separate housing compartment relative to the main switch gear housing wall.
Figure 11:
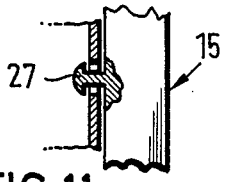
FIG. 11 is a fragmentary cross-sectional view taken generally along line XI—XI of FIG. 9, and illustrates in more detail the clamping connection of FIGS. 9 and 10.
Figure 12:
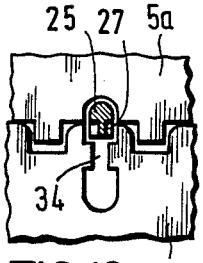
FIG. 12 is a fragmentary view taken generally along line XII—XII of FIG. 9, and illustrates the relationship of the switch gear of the main housing wall and the associated separate housing compartment prior to the effective clamp connection therebetween.
Figure 13:
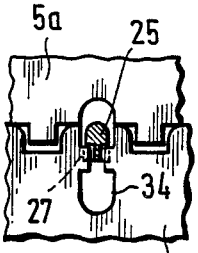
FIG. 13 is a fragmentary view identical to FIG. 12, but illustrates the separate housing compartment in the position corresponding to that of FIG. 10.

An essential aspect of the invention is the fact that the housing compartments 14, 15 can be assembled or secured to the walls or sides 4, 5 of the housing 1 in two different positions mutually displaced, offset or rotated 180° relative to each other so that the connector screws 19 can be accessed or manipulated from above or below, as shown respectively by the housing compartment 14 in FIG. 2 and the housing compartment 15 in FIG. 2, respectively. The housing compartments 14, 15 are shown in FIGS. 1 and 2 spaced from the main switch gear housing 1 simply for clarity, but when assembled tight against the side walls or sides 4, 5 of the housing 1, the exposed ends (unnumbered) of the fixed contact rails 8 through 13 enter the housing compartments 14, 15 and also enter the metal cages 23 thereof. The latter is further enhanced by guiding and locking means in the form of two barbell shaped slots 30, 33 and 34, 35 formed in respective sides or side walls 4, 5 of the housing 1 in the areas between the three fixed contact rails 8, 9 and 10 on the one hand, and 11, 12 and 13 on the other at the opposite side wall or side 5. Each of the slots 30, 33, 34 and 35 has a central narrow slot portion or zone and opposite rounded-off enlarged or broadened ends or zones 31, 32. Furthermore, each housing compartment 14, 15 includes semi-cylindrical projections 24, 25 which slip into the wider portions 31, 32, selectively depending upon whether the heads of the screws 19 are accessible from above or below. As shown in FIG. 1, the semi-cylindrical projections 24, 25 of the housing compartment 14 are insertible into the upper wider portions 31 of the slots 30, 33 whereas the housing compartment 15 in FIGS. 1 and 2 is rotated 180° relative to the housing compartment 14, its screws are accessible from below (FIG. 2), and thus its projections 24, 25 are received in the lower widened portions or zones 32 of the slots 34, 35. Just as obviously, if the housing compartment 14 were rotated 180° from the position shown in FIG. 1, the semi-cylindrical projections 24, 25 would be received in the widened zones 32 of the respective slots 33, 30. Each semi-cylindrical projection 24, 25 is also provided on the one side with a respective boss 26, 27 (FIG. 2) having bi-lateral undercut guide grooves 28, 29. The bosses 26, 27 thereby grip from the rear the edges (unnumbered) of the narrow portions of the associated slots 30, 33 after the housing compartments 14, 15 have been moved tight against the walls 4, 5. Reference is made to FIGS. 9 and 12 which graphically illustrate one of the projections 25 of the housing compartment 15 positioned within the slot 34 in the upper widened portion thereof. FIG. 11 also graphically depicts this relationship prior to the housing compartment 15 being moved downwardly to the position shown in FIGS. 10 and 13 at which time the housing compartment 15 is automatically clamped in the narrow portion of the slot 34 by means of the boss 27 engaging against the inside surface (unnumbered) of the side wall 5, as is most apparent from FIGS. 10 and 13. Thus, by simply moving either of the compartments 14, 15 up or down, locking or unlocking/clamping or unclamping thereof relative to the associated walls 4, 5 can be readily achieved.

Figure 5:
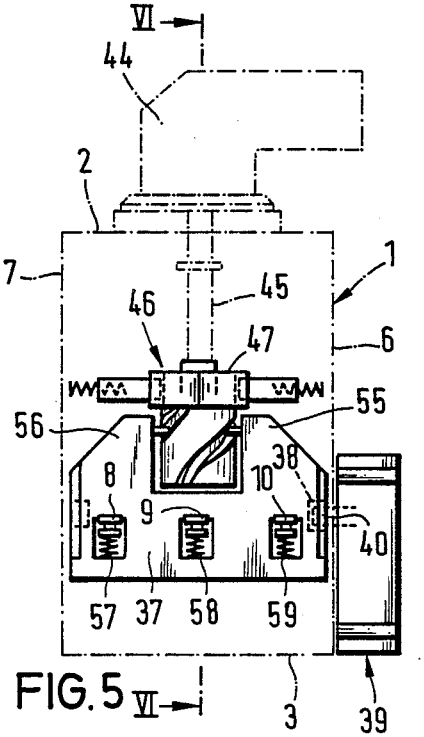
FIG. 5 is a fragmentary view of the switch gear with the housing removed, and illustrates the second position in which the contact bridge holder has been elevated as compared to the position shown in FIG. 3.
Figure 18:
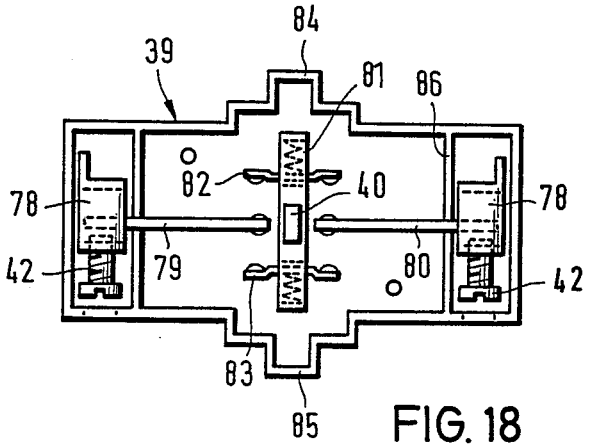
FIG. 18 is a vertical sectional view through one of the auxiliary contact compartments shown in FIG. 1, and illustrates similar contact rails, cages and screws associated therewith.

In further accordance with this invention there is provided one or more auxiliary contact compartments or housings 39 which may be mounted or clamped to the side walls 6, 7 of the housing 1. The compartments 39 can also be selectively rotated 180° relative to each other whereby associated connector screws 42 thereof (FIGS. 1, 3, 5, 14 and 18) can be accessed or manipulated from above or below, namely, from the side of the top wall or front wall 2 or from the side of the bottom or rear wall 3. The side wall 6, 7 of the housing 1 which receive the auxiliary contact compartments 39 are also provided with vertical rectangular slots 36, as shown in FIG. 1. As will be discussed more fully hereinafter, a contact bridge holder 37 having a clearance or recess 38 is located within the compartment on the inside of and aligned with the slot 36. As shown in FIG. 18, an auxiliary contact bridge holder 81 is provided within the auxiliary contact compartment 39 and includes a projection 40 (FIGS. 1, 3 and 5). When the auxiliary contact compartment 39 rests in its selected position against the particular side wall 6 or 7, and if illustratively it is fixed in place by screws (unnumbered in FIG. 1), the projection 40 thereof passes through the slot 36, enters into the housing 1, and positively locks in the clearance 38 (See FIGS. 3 and 5).

Figure 8:
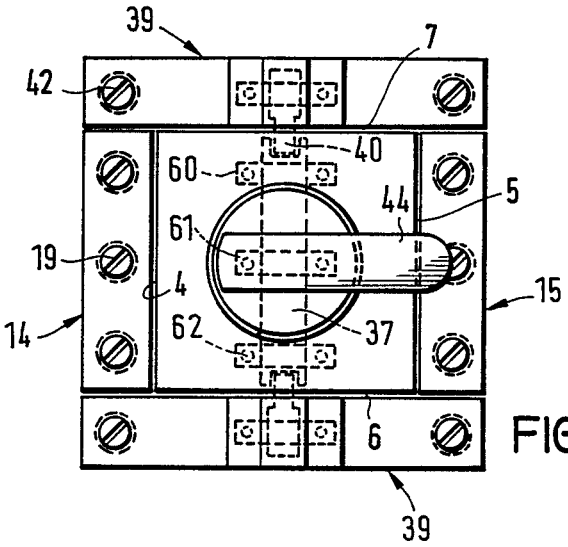
FIG. 8 is a top plan view of the assembled switch gear, and illustrates two separate housing compartments and two separate auxiliary contact compartments secured to four side walls of the main switch gear housing.

In order to mount the auxiliary contact compartments 39 selectively in either position, as discussed immediately heretofore, so that the switching function ("ON" and "OFF") remain unchanged, the auxiliary contact bridge holder 81 is provided with two contact bridges 82, 83 (FIG. 18) which can be displaced to either side from centrally mounted fixed contact rails 79 and 80. The auxiliary contact bridges 82, 83 are held in the auxiliary contact bridge holder 81 by means of compression springs (unnumbered in FIG. 18). Depending upon the position selected at the housing 1, the auxiliary contact bridge holder 81 during the "ON" operation moves, as viewed in FIG. 18, either up or down so that either of the contact bridges 82, 83 of the contact bridge 81 performs the switching "ON" operation. During this displacement, the auxiliary contact bridge holder 81 is guided by omitted ribs and by the guidance components or channels 84 and 85. The outer ends of the fixed contact rails 79, 80 are each connected with associated metal cages 78 housing the connector screws 42 (FIG. 18). Apertures 43 (FIG. 1) receive connection leads at the adjoining end faces of the auxiliary contact compartments 39. As shown in particular in FIG. 8, the auxiliary contact compartments 39 are designed to be wide enough so that the end faces in which the apertures 43 are located are flush with the outer surfaces of the housing compartments 14, 15. Thus, the overall appearance of the switch gear, as best seen in FIG. 8, is likewise of a rectangular profile of maximum efficiency when considered from a space standpoint. The connector screws 19 and 42 and also the apertures 20, 21, 22 and 43 are serially arranged on both sides of the housing 1. If as shown in FIG. 1, the auxiliary contact compartment 39 is covered by a panel then, obviously, this panel must also have the slot 41 formed therein, corresponding to the slot 36, to allow the projection 40 to pass therethrough.

Figure 4:
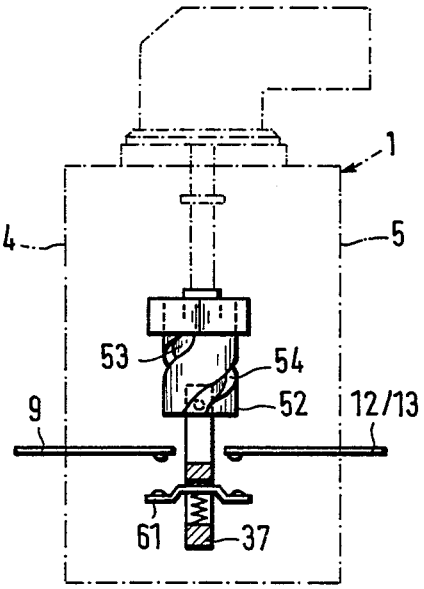
FIG. 4 is a fragmentary view of the switch gear taken along the line IV—IV of FIG. 3, and illustrates the open ("ON") position of one of the switches in which the main contacts of the main contact bridge are spaced from the fixed contact rails of the switch gear housing.
Figure 6:
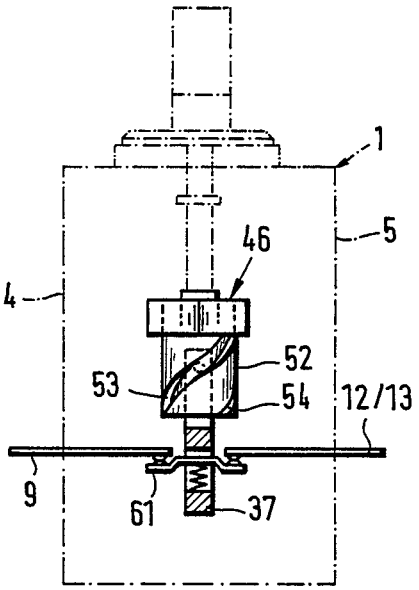
FIG. 6 is a fragmentary view looking along the line VI—VI FIG. 5, and illustrates the closed ("OFF") position of the contacts.

FIGS. 3, 4 and 6 show three main contact bridges 60, 61 and 62 mounted on a common contact bridge holder 37. The three main contact bridges 60, 61 and 62 are spring-loaded inside rectangular windows, slots or apertures 57, 58 and 59. The actuation means of the invention associated with the switch gear 1 is through a rotary handle 44 designed so that rotation thereof moves the contact bridge holder 37 toward and/or away from the walls or sides 2, 3 and generally transverse or normal thereto. This is most apparent from the "OFF" position of FIG. 3 and the "ON" position of FIG. 5 which, of course, is also reflected in FIGS. 4 and 6, respectively.

Figure 15:
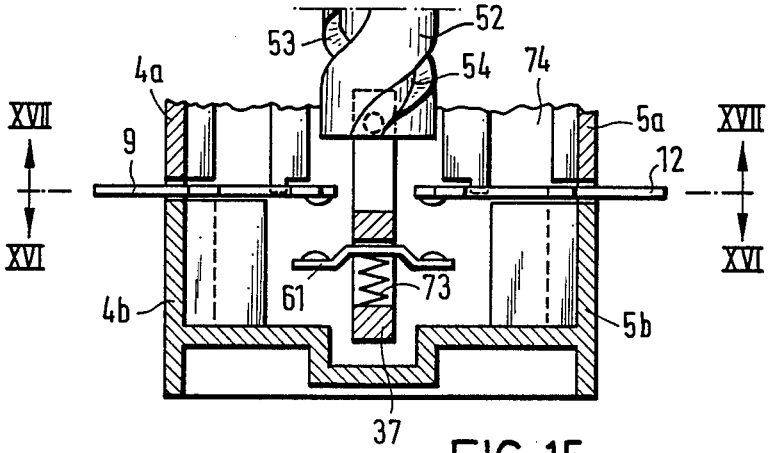
FIG. 15 is a vertical sectional view taken through a lower portion of the main switch gear housing, and illustrates the contacts opened when the contact bridge holder is in its lower position, as is FIG. 3 and 4.

The actuation means, including the rotary handle 44, carries a spindle 45 whose axis is normal to the top 2 and bottom 3 of the housing 1. The spindle 45 passes through a snap-in device or collar 46 (FIGS. 3, 5 and 19) and enters a cylindrical component, body or member 52 (FIGS. 4, 6 and 15). The cylindrical body 52 is provided with cam and cam follower means in the form of two screw threads, channels or grooves 53, 54 which guidingly receive pins or followers 63, 64 (FIG. 3) of the contact bridge holder 37. Thus, by rotating the rotary handle 44 and, thus, the spindle 45, the cylindrical body 52 is rotated carrying the contact bridge holder 37 up and/or down by the interaction between the pins 63, 64 and the grooves 53, 54. As shown in FIGS. 3 and 5, the contact-bridge holder 37 is essentially U-shaped and includes legs 55, 56. The distance between and the length of the two legs 55, 56 of the contact bridge holder 37 are selected in such a manner that in one switch position ("ON"), the cylindrical body 52 is seated in the clearance between the two legs 55, 56; whereas in the other position ("OFF"), the cylindrical body 52 will be elevated above and partially removed from the clearance between two legs 55, 56 (FIG. 3). The projections 63, 64 preferably project radially from the ends of the legs 55, 56 so that they project into and are retained by the respective grooves 53, 54.

Figure 19:
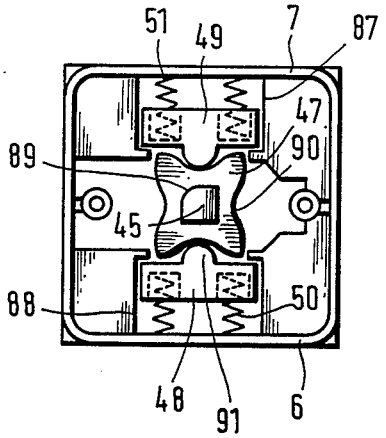
FIG. 19 is a horizontal cross-sectional view taken through the switch gear main housing looking downwardly in FIG. 1, and illustrates the manner in which a pair of spring-biased slides cooperate with recesses of a collar carried by a spindle to retain the bridge holder in either of its two positions, as best shown in FIGS. 3, 4 and 5, 6.

Reference is now made to FIG. 19 which illustrates that the snap-in device or collar 46 includes a central body 47 having four peripherally equidistantly spaced niches or recesses 90. Two mutually opposite/opposing sliders 48, 49 are mounted in the housing 1 in opposed relationship to the rotating body 47 and each slider 48, 49 includes a boss or nose 91 which is designed to enter selected ones of the recesses 90. Each slider 48, 49 is spring-biased by compression springs 50, 51 toward the spindle 45. The sliders 48, 49 are also guided between two parallel guide means or walls 87, 88 of the housing 1. The cylindrical body 52 and the rotating body 47 of the snap-in device or collar 46 are integral and have a cross-sectional square hole (unnumbered) with a beveled or radius edge 89. The cross-section of the spindle 45 of the rotary handle 44 is correspondingly fitted in the area of the latter hole. Stop means (not shown) are provided which constrain rotation of the rotary handle 44 between the two switch positions ("ON" - "OFF"). Essentially, the latter is achieved by the snap-in device or collar 46 and the associated bosses 91, yet the rotation of the spindle 45 permits rapid and reliable operation of the bridge holder 37 between these "ON" and "OFF" positions.

Figure 14:
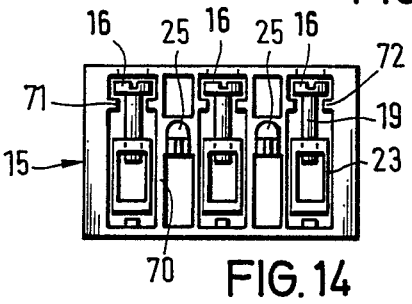
FIG. 14 is an elevational view of the inside of the main housing compartment of the gear box along the line XIV—XIV of FIG. 9, and illustrates connector screws held captive in a compartment and carrying metallic cages for connection to electrical leads.

As is further illustrated in FIGS. 2 and 7, a hollow cylinder, tube or sleeve 65 has a cylindrical bore (unnumbered) in which seats the spindle 45 approximately between the snap-in device or collar 46 and the rotary handle 44. An essentially U-shaped spring clip 66 having legs 67, 68 received in two notches 69 facilitates the assembly of the latter structure. The housing compartments 14, 15 are also constructed to prevent the screws 19 from shifting through the utilization of ridges 71, 72 (FIG. 14). The ridges 71, 72 engage the undersurfaces of the heads (unnumbered) of the screws 19. Each screw 19 can, of course, enter a threaded bore (unnumbered) of each rectangular metal cage 23 and when threaded, the metal cage 23 can be displaced because the head of the screw 19 is confined against axial movement and the cages 23 are confined against rotation. Obviously, the metal cages 23 are separated from each other by ribs 70 (FIG. 14) for insulation purposes and also to assist in guiding the motion of the cages up or down, again as viewed in FIG. 14. Corresponding ribs 86 (FIG. 18) may be provided in the auxiliary contact compartments 14, 15 for similar guidance.

Figure 16:
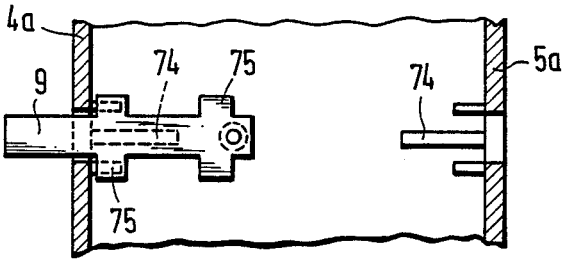
FIG. 16 is a fragmentary sectional view taken generally along line XVI—XVI of FIG. 15, and illustrates the manner in which one of six fixed contact rails are mounted within the housing.
Figure 17:
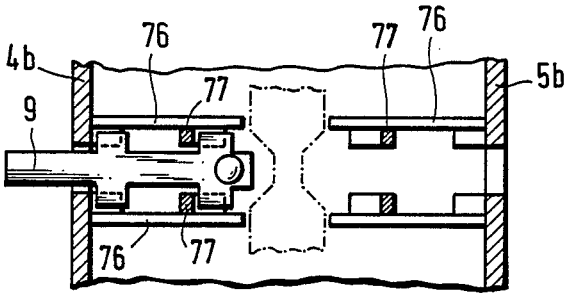
FIG. 17 is a fragmentary cross-sectional view taken generally along line XVII—XVII of FIG. 15, and illustrates pairs of spaced ribs for retaining the fixed contact rail in the position shown.

FIGS. 15 through 17 show several design details, including a compression spring 73 maintaining the main contact bridge 61 and the associated windows or slots 57 through 59 of the contact bridge holder 37. The positive locking fastening means for the fixed contact rails 9, 12 is also shown. These contact rails 9, 12 are kept in position from above by means of the associated ribs 74. Also to prevent the main contact rails 9, 12, for example, from shifting longitudinally, they are provided with widened arms or cross bars 75 retained between ribs 76 and stops 77. Furthermore, in order to more easily mount the fixed contact rails 9, 12, for example, or any of the remaining fixed contact rails, the housing 1 is advantageously divided near the fixed contact rails, as shown at *4a*, *4b* and *5a*, *5b* (FIG. 15) and as is also apparent in FIGS. 12 and 13.

Although in a preferred embodiment of the invention as has been specifically illustrated and described herein, it is to be understood that minor variations may be made in the apparatus without departing from the spirit and scope of the invention, as defined in the amended claims.

We claim:

1. A switch gear comprising a housing including opposite first and second sides and a third side therebetween, at least one main contact bridge in said housing means for supporting said main contact bridge for displacement between two switch positions, actuating means accessible at said third side for displacing said one main contact bridge between said two switch positions, two fixed contact rails carried by said housing and cooperating with said one main contact bridge for effecting therewith one closed and one open switch position, first and second of said two fixed contact rails being connectable by connector screws to electrical hook-up leads at said respective first and second housing sides, first and second separate housing compartments adjacent said respective first and second housing sides and housing associated ones of said connector screws, means for connecting said first and second fixed contact rails through said respective first and second separate housing compartments for connecting to said electrical hook-up leads by said connector screws, and means for selectively mounting said first and second separate housing compartments to the respective first and second housing sides at two positions mutually displaced by 180° whereby said connector screws can be accessed from two different opposing directions.

2. The switch gear as defined in claim 1 wherein said first and second fixed contact rails project beyond said first and second housing sides, and said fixed contact rail connecting means include first and second openings in said respective first and second separate housing compartments for introducing thereinto said projecting fixed contact rails.

3. The switch gear as defined in claim 1 wherein said housing includes a fourth side opposite to said third side, said third and fourth sides being connected between said first and second housing sides, first and second auxiliary contact compartments, contacts in said first and second auxiliary contact compartments, and means for selectively mounting said first and second auxiliary contact compartments upon said respective third and fourth housing sides at two positions mutually displaced by 180° whereby said auxiliary contact compartments can be acted upon from either of two opposite sides thereof.

4. The switch gear as defined in claim 1 including at least two other fixed contact rails carried by said housing parallel to said first-mentioned two fixed contact rails, another main contact bridge cooperative with said two other fixed contact rails, for effecting therewith one closed and one open switch position and said actuating means displaces said main contact bridges in a direction transverse to said third housing side.

5. The switch gear as defined in claim 1 including means mounting said actuating means for displacement in a direction generally normal to said third housing side for effecting said two switch positions.

6. The switch gear as defined in claim 1 including means mounting said actuating means for rotation and displacement in a direction generally normal to said third housing side for effecting said two switch positions.

7. The switch gear as defined in claim 1 including means mounting said actuating means for rotation and displacement in a direction generally normal to said third housing side for effecting said two switch positions, and said displacement normal to said third housing side is effected by cooperative cam and follower means between said actuating means and said main contact bridge.

8. The switch gear as defined in claim 1 including means mounting said actuating means for rotation and displacement in a direction generally normal to said third housing side for effecting said two switch positions, means mounting said main contact bridge for sliding movement generally normal to said third housing side, and said displacement normal to said third housing side is effected by cooperative cam and cam follower means between said actuating means and said main contact bridge.

9. The switch gear as defined in claim 1 including means mounting said actuating means for rotation and displacement in a direction generally normal to said third housing side for effecting said two switch positions, means mounting said main contact bridge for sliding movement generally normal to said third housing side, said displacement normal to said third housing side is effected by cooperative cam and cam follower means between said actuating means and said main contact bridge, and said cam and cam follower means is a slot receiving a pin respectively.

10. The switch gear as defined in claim 1 including means mounting said actuating means for rotation and displacement in a direction generally normal to said third housing side for effecting said two switch positions, means mounting said main contact bridge for sliding movement generally normal to said third housing side, said displacement normal to said third housing side is effected by cooperative cam and cam follower means between said actuating means and said main contact bridge, and said cam and cam follower means is a slot receiving a pin respectively, of said actuating means and main contact bridge, respectively.

11. The switch gear as defined in claim 1 wherein said actuating means includes a rotatable spindle, a collar carried by said spindle and rotatable therewith, and said collar includes peripheral surface means for locking said spindle in different selected positions of rotation thereof.

12. The switch gear as defined in claim 1 including means mounting said actuating means for rotation and displacement in a direction generally normal to said third housing side for effecting said two switch positions, means mounting said main contact bridge for sliding movement generally normal to said third housing side, said displacement normal to said third housing side is effected by cooperative cam and cam follower means between said actuating means and said main contact bridge, and said cam and cam follower means are a pair of slots each receiving a pin, respectively.

13. The switch gear as defined in claim 1 wherein said main contact bridge includes a generally U-shaped holder defined by a bight and two legs collectively defining a slot of predetermined width and length, said actuating means includes a displaceable member generally housed in and movable relative to said slot, said displaceable member includes a cam, and at least one of said legs carries a cam follower in and guided by said cam.

14. The switch gear as defined in claim 1 wherein said main contact bridge includes a generally U-shaped holder defined by a bight and two legs collectively defining a slot of predetermined width and length, said actuating means includes a displaceable member generally housed in and movable relative to said slot, said displaceable member includes a cam, at least one of said legs carries a cam follower in and guided by said cam, and said cam and cam follower are a slot and pin, respectively.

15. The switch gear as defined in claim 1 wherein said main contact bridge includes a generally U-shaped holder defined by a bight and two legs collectively defining a slot of predetermined width and length, said actuating means includes a displaceable member generally housed in and movable relative to said slot, said displaceable member includes a cam, at least one of said legs carries a cam follower in and guided by said cam, and said cam and cam follower are at least a slot and a pair of pins respectively carried by said displaceable member and legs, respectively.

16. The switch gear as defined in claim 1 wherein said actuating means includes a rotatable spindle, a collar carried by said spindle and rotatable therewith, said collar includes peripheral surface means for locking said spindle in different selected positions of rotation thereof, said peripheral surface means are a plurality of peripherally spaced outwardly opening recesses, and at least one locking slide spring biased into locking relationship in selected ones of said recesses.

17. The switch gear as defined in claim 1 wherein said actuating means includes a rotatable spindle, a collar carried by said spindle and rotatable therewith, said collar includes peripheral surface means for locking said spindle in different selected positions of rotation thereof, said peripheral surface means are a plurality of peripherally spaced outwardly opening recesses, and at least two opposing locking slides each spring biased into locking relationship in selected ones of said recesses.

18. The switch gear as defined in claim 1 wherein said actuating means includes a rotatable spindle, a collar carried by said spindle and rotatable therewith, said collar includes peripheral surface means for locking said spindle in different selected positions of rotation thereof, said peripheral surface means are a plurality of peripherally spaced outwardly opening recesses, at least one locking slide spring biased into locking relationship in selected ones of said recesses, a pair of spaced ridges in said housing, and said slide is retained between and is guided by said ridges.

19. The switch gear as defined in claim 1 wherein said selective mounting means includes a generally bar-bell shaped slot in each of said first and second housing sides, and each of said first and second separate housing compartments include at least one projection sized for receipt into enlarged portions of said bar-bell shaped slots.

20. The switch gear as defined in claim 1 wherein said selective mounting means includes a generally bar-bell shaped slot in each of said first and second housing sides, and each of said first and second separate housing compartments include at least one semi-cylindrical projection sized for receipt into enlarged portions of said bar-bell shaped slots.

21. The switch gear as defined in claim 1 wherein said selective mounting means includes a generally bar-bell shaped slot in each of said first and second housing sides, each of said first and second separate housing compartments include at least one semi-cylindrical projection sized for receipt into enlarged portions of said bar-bell shaped slots, and each projection include a pair of grooves for receiving edge portions of narrower portions of said bar-bell shaped slots.

22. The switch gear as defined in claim 1 including first and second metallic cages carried by said first and second separate housing compartments respectively, and said connector screws being carried by associated ones of said metallic cages.

23. The switch gear as defined in claim 1 including first and second metallic cages carried by said first and second separate housing compartments respectively, said connector screws being carried by associated ones of said metallic cages, boreholes in said first and second separate housing compartments through which said connector screws are accessible, and means for preventing removal of said connector screws through said boreholes.

24. The switch gear as defined in claim 1 wherein said housing includes a fourth side opposite to said third side, said third and fourth sides being connected between said first and second housing sides, first and second auxiliary contact compartments, contacts in said first and second auxiliary contact compartments, means for selectively mounting said first and second auxiliary contact compartments upon said respective third and fourth housing sides at two positions mutually displaced by 180° whereby said auxiliary contact compartments can be acted upon from either of two opposite sides thereof, said third and fourth housing sides each has a slot aligned with a contact bridge holder in said housing, and said first and second auxiliary contact compartments each includes an auxiliary contact projection received in an associated one of said slots.

* * * * *